US005979575A

United States Patent [19]

Overstreet et al.

[11] Patent Number: 5,979,575

[45] Date of Patent: Nov. 9, 1999

[54] HYBRID ROCK BIT

[75] Inventors: James L. Overstreet, Webster; Robert E. Grimes, Houston; Brian A. Baker; Matthew J. Meiners, both of Spring, all of Tex.

[73] Assignee: Baker Hughes Incorporated, Houston, Tex.

[21] Appl. No.: 09/104,821

[22] Filed: Jun. 25, 1998

[51] Int. Cl.[6] ..... E21B 10/16

[52] U.S. Cl. ..... 175/374; 175/341; 175/378

[58] Field of Search ..... 175/331, 374, 175/341, 378

[56] References Cited

U.S. PATENT DOCUMENTS 4,940,099 7/1990 Deane et al. .
5,131,480 7/1992 Lockstedt et al. .
5,224,560 7/1993 Fernandez .
5,351,768 10/1994 Scott et al. ..... 175/374
5,353,885 10/1994 Hooper et al. .
5,445,231 8/1995 Scott et al. ..... 175/374
5,542,485 8/1996 Pessier et al. ..... 175/371
5,833,020 11/1998 Portwood et al. ..... 175/331

*Primary Examiner*—David Bagnell
*Assistant Examiner*—Zakiya Walker
*Attorney, Agent, or Firm*—James E. Bradley

[57] ABSTRACT

An earth-boring bit has a rotating cutter of a hybrid design. The bit has a bit body and a bearing shaft which is cantilevered downwardly and inwardly from the bit body. The cutter is mounted for rotation on the bearing shaft and has a plurality of cutting elements arranged in circumferential rows on the cutter. These rows include inner rows and a heel row. The cutting elements in the inner row are formed of a hard metal such as tungsten carbide and are pressed interferingly into apertures in the cutter. The heel row is made up of steel teeth formed on the cutter.

15 Claims, 2 Drawing Sheets

HYBRID ROCK BIT

TECHNICAL FIELD

This invention relates generally to earth-boring drill bits and particularly to improved cutting structures for such bits.

BACKGROUND ART

In drilling bore holes in earthen formations by the rotary method, rock bits fitted with one, two or three rolling cutters are employed. The bit is secured to the lower end of a drillstring that is rotated from the surface, or the bit is rotated by downhole motors or turbines. The cutters mounted on the bit roll and slide upon the bottom of the bore hole as the bit is rotated, thereby engaging and disengaging the formation material to be removed. The roller cutters are provided with cutting elements that are forced to penetrate and gouge the bottom of the borehole by weight of the drillstring. The cuttings from the bottom and sidewalls of the borehole are washed away by drilling fluid that is pumped down from the surface through the hollow drillstring.

One type of cutting element in widespread use is a tungsten carbide insert which is interference pressed into an aperture in the cutter body. Tungsten carbide is metal which is harder than the steel body of the cutter and has a cylindrical portion and a cutting tip portion. The cutting tip portion is formed in various configurations, such as chisel, hemispherical or conical, depending upon the type of formation to be drilled. Some of the inserts have very aggressive cutting structure designs and carbide grades that allow the bits to drill in both soft and medium formations with the same bit.

Although very successful, several areas in the world have relatively soft non-abrasive formations which can cause severe frictional heat cracks to the outer ends of the inserts which rub on the borehole wall. Premature failure of the heel row inserts occurs when harder formations are encountered later in the run.

Another type of rolling cutter earth-boring bit is commonly known as a "steel-tooth" or "milled-tooth" bit. Typically these bits are for penetration into relatively soft geological formations of the earth. The strength and fracture-toughness of the steel teeth permits the use of relatively long teeth, which enables the aggressive gouging and scraping actions that are advantageous for rapid penetration of soft formations with low compressive strengths.

However, it is rare that geological formations consist entirely of soft material with low compressive strength. Often, there are streaks of hard, abrasive materials that a steel-tooth bit should penetrate economically without damage to the bit. Although steel teeth possess good strength, abrasion resistance is inadequate to permit continued rapid penetration of hard or abrasive streaks. Consequently, it has been common in the arts since at least the 1930s to provide a layer of wear-resistance metallurgical material called "hardfacing" over those portions of the teeth exposed to the severest wear. The hardfacing typically consists of extremely hard particles, such as sintered, cast or macro-crystalline tungsten carbide, dispersed in a steel matrix. Such hardfacing materials are applied by welding a metallic matrix to the surface to be hardfaced and applying the hard particles to the matrix to form a uniform dispersion of hard particles in the matrix.

Unlike a tungsten carbide insert bit, teeth of a steel-tooth bit are not susceptible to stress cracking due to excessive heat. A steel-tooth bit would be able to drill the relatively soft non-abrasive formations mentioned above which cause stress cracking on heel rows of insert bits. However, because of the hardness and thickness of adjacent formations, a steel-tooth bit would wear too quickly, thus is not a preferred choice in those areas.

DISCLOSURE OF INVENTION

In this invention, a hybrid cutter is provided. The inner rows of the cutter have cutting elements formed of a hard metal interference fit into apertures in the cutter. The heel row, however, is formed of steel teeth. The steel teeth have hardfacing which makes them tough enough to successfully drill medium hard formations, yet they are not subject to cracking, chipping and/or breaking as a result of excessive frictional heat which otherwise might occur with tungsten carbide inserts.

In addition, the cutter may be provided with gage inserts and scraper row inserts of hard metal. The scraper row inserts may be tungsten carbide inserted into apertures in the cutter. Alternately, they may comprise cutting members made up of hardfacing.

BEST MODE OF CARRYING OUT THE INVENTION

Figure 1:
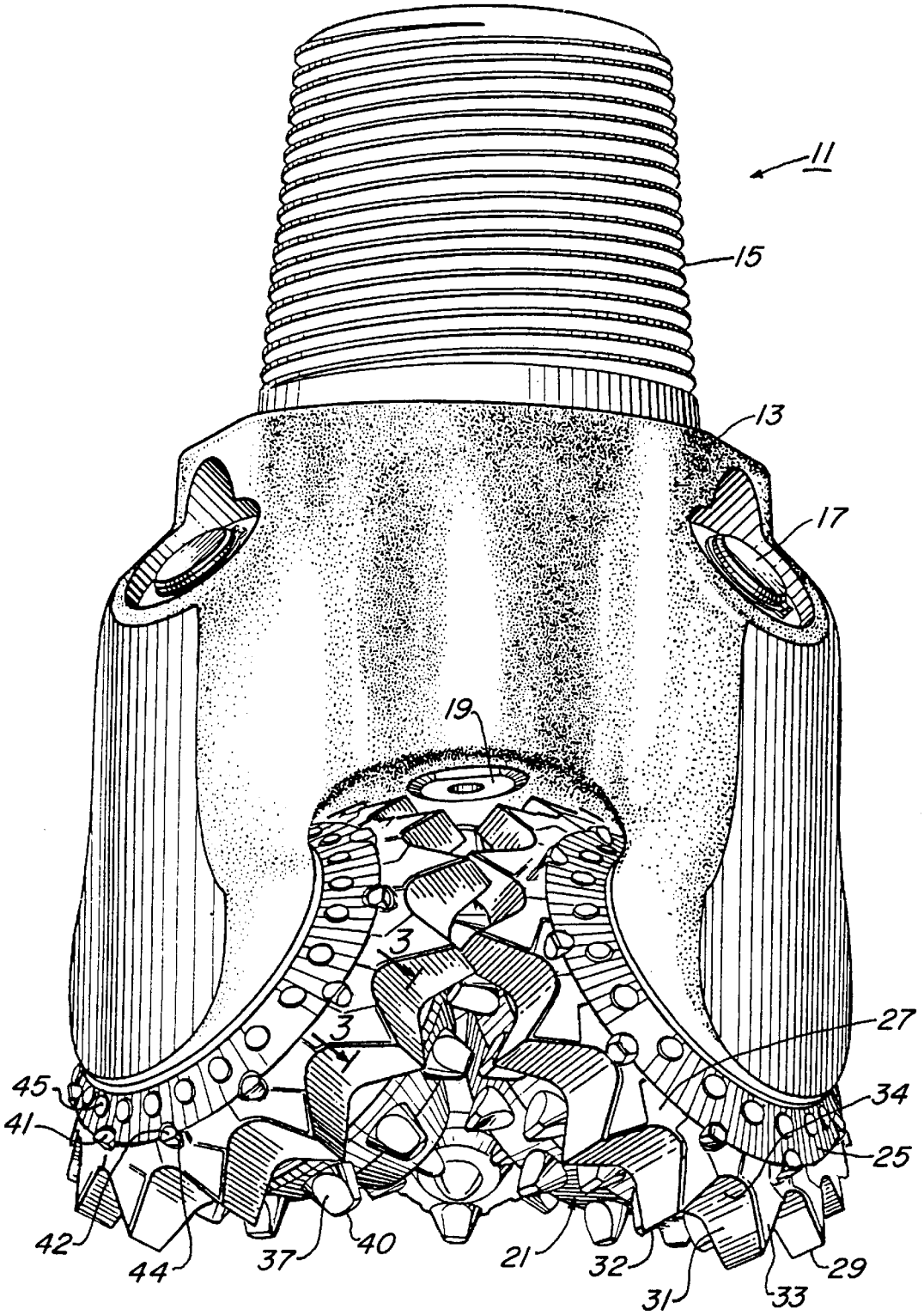
FIG. 1 is a perspective view of an earth-boring bit constructed in accordance with this invention.

Referring to FIG. 1, an earth-boring bit 11 according to the present invention is illustrated. Bit 11 includes a bit body 13 which is threaded at its upper extent 15 for connection into a drillstring. Each leg of bit 11 is provided with a lubricant compensator 17, a preferred embodiment which is disclosed in U.S. Pat. No. 4,276,946, Jul. 7, 1981, to Millsapps. At least one nozzle 19 is provided in bit body 13 to spray drilling fluid from within the drill string to cool and lubricate bit 11 during drilling operation. Three cutters 21 are rotatably secured to the legs of bit body 13. Each cutter 21 has a cutter shell surface including a gage surface 25 and a heel region indicated generally at 27.

Steel teeth 29 are formed in heel region 27. Steel teeth 29 are of generally conventional design, each having two flanks 31 which converge to a crest 32. Each tooth 29 has an inner end (not shown) and an outer end 33 which join crest 32. A valley or root 34 is located between each tooth 29. Gage surface 25 extends generally to and borders the outer ends 33 of teeth 29.

Figure 3:
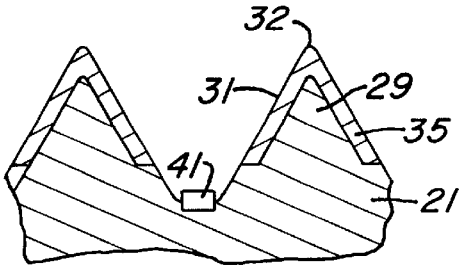
FIG. 3 is a sectional view of two of the heel row steel teeth of the bit of FIG. 1, taken along the line 3—3 of FIG. 1.

Referring to FIG. 3, hardfacing 35 is formed on each of the teeth 29. Hardfacing 35 preferably covers the entire tooth 29, including flanks 31, crest 32 and outer end 33. Hardfacing 35 is a metallic matrix having carbide particles therein. It may be placed on the teeth as shown in U.S. Pat. Nos. 5,492,186, Feb. 20, 1996, Overstreet et al., 5,445,231, Aug. 29, 1995, Scott et al. and 5,351,771, Oct. 4, 1994, Zahradnik.

Figure 2:
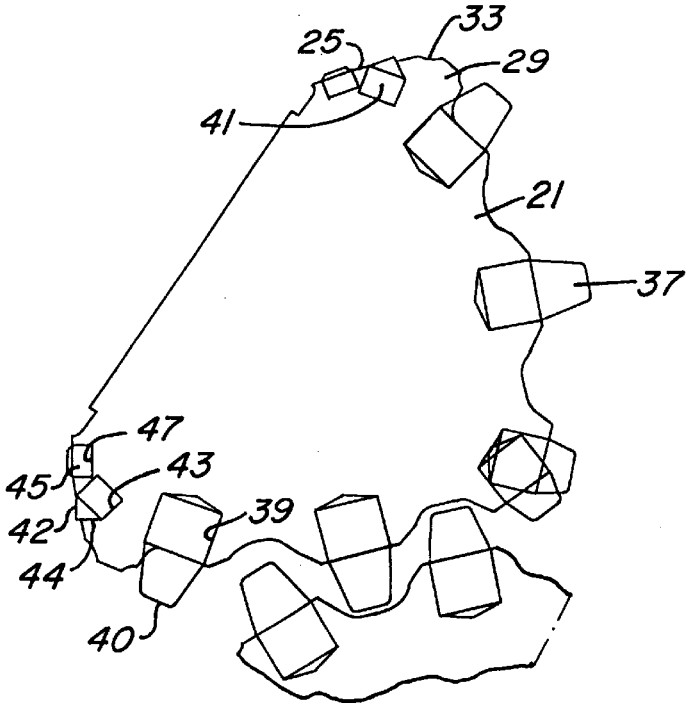
FIG. 2 is a fragmentary sectional view perpendicular to the longitudinal axis of the bit body, illustrating a portion of two of the cutters of the bit of FIG. 1.

Referring to FIGS. 1 and 2, for the purposes herein all of the cutting elements located radially inward from steel teeth 29 are referred to inner row inserts 37. There are two separate regions of inner row inserts 37 located radially outward from the apex of each cutter 21. Two of the cutters 21 will also have one or more inner row inserts 37 located at the apex of cutter 21. Inner row inserts 37 are of a conventional type, being of hard metal and interferingly pressed into apertures 39 in the shell of cutter 21. Inner row inserts 37 may be formed entirely of sintered tungsten carbide as well as sintered tungsten carbide which may have a layer of diamond material. The protruding cutting tip configuration shown in FIG. 2 is of a chisel shape, having an elongated crest 40, however it may be of various shapes.

Referring again to FIG. 1, there may also be a plurality of scraper inserts 41 installed generally at the intersection of gage surface 25 and heel region 27 which contains the row of steel teeth 29. Each scraper insert 41 in the embodiment of FIGS. 1–3, is a hard metal insert, preferably of tungsten carbide, inserted interferingly into an aperture 43 in cutter 21. Each insert 41 is generally located halfway between and radially outward from two of the steel teeth 29. Scraper inserts 41 are used for engaging the sidewall of the borehole during cutting. Scraper inserts 41 have a gage insert surface 42 and a heel insert surface 44 to define a cutting edge for engagement with the sidewall of the borehole. Scraper inserts 41 are preferably constructed as described in U.S. Pat. No. 5,351,768, Oct. 4, 1994, Scott et al.

In addition, a plurality of gage inserts 45 may be spaced around gage surface 25 for resisting wear. Gage inserts 45 are also of a hard metal, preferably tungsten carbide inserted within mating holes 47 (FIG. 2) in an interference fit. Each gage insert 45 has a flat outer side which protrudes slightly from gage surface 25 and engages the borehole wall.

In operation, in certain non-abrasive formations, substantial heat will normally be generated caused by cyclic rubbing of the outer ends 33 of steel teeth 29 on the borehole wall. This heat will not be high enough to degrade teeth 29, therefore they will continue to function well while in the non-abrasive formations. The inner row inserts 37, being spaced farther from the borehole wall than steel teeth 29, will not reach temperatures as high as steel teeth 29. Inner row inserts 37 will not reach temperatures high enough to cause heat cracking. As the drilling continues out of the non-abrasive formation and into harder formations, steel teeth 29 are able to avoid excessive wear because of hardfacing 35. The inner row inserts 37, being of tungsten carbide, are able to efficiently cut through the harder formations encountered in these areas.

Figure 4:
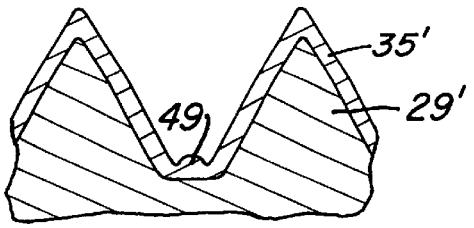
FIG. 4 is a sectional view, similar to FIG. 3, shown with an alternate embodiment of a scraper insert.

FIG. 4 shows an alternate embodiment. Instead of using tungsten carbide scraper inserts 41, scraper cutting elements 49 formed entirely of a hardfacing material may be employed. Scraper elements 49 are formed by the same technique as is commonly employed when applying hardfacing 35' to teeth 29'. The hardfacing is built up into a generally outward protrusion 49 for engaging the borehole wall to cut and function in the same manner as scraper inserts 41.

The invention has significant advantages. The invention provides a hybrid bit that has steel-tooth heel rows and tungsten carbide insert inner rows. The inner rows provide an aggressive cutting structure which allows the bit to drill both in soft and in medium formations. The steel-tooth outer rows are not susceptible to heat stress fractures, thus avoids cracking and chipping due excessive heat.

While the invention has been shown in only two of its forms, it should be apparent to those skilled in the art that it is not so limited, but is susceptible to various changes without departing from the scope of the invention.

We claim:

1. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in circumferential rows on the cutter, the rows including at least one inner row and a heel row;

the cutting elements in the inner row being formed of hard metal and interference fit into apertures in the cutter; and at least some of the cutting elements in the heel row being steel teeth formed on the cutter.

2. The earth-boring bit according to claim 1, wherein the cutter has a gage surface and an adjoining heel region, and wherein the steel teeth are in the heel region.

3. The earth-boring bit according to claim 1, wherein each of the steel teeth has a pair of flanks converging to a crest and inner and outer ends.

4. The earth-boring bit according to claim 1, wherein:

the cutter has a gage surface and an adjoining heel region;

the cutting elements in the heel row are formed in the heel region; and the bit further comprises:

a plurality of scraper elements protruding from the cutter generally at a border between the gage surface and the heel region.

5. The earth-boring bit according to claim 1, wherein:

the cutter has a gage surface and an adjoining heel region;

the cutting elements in the heel row are formed in the heel region; and the bit further comprises:

a plurality of scraper elements protruding from the cutter generally at a border between the gage surface and the heel region, each of the scraper elements being formed of a wear-resistant hardfacing material deposited on the cutter, each of the scraper elements being spaced outward from and between two of the steel teeth.

6. The earth-boring bit according to claim 1, wherein:

the cutter has a gage surface and an adjoining heel region;

the cutting elements in the heel row are formed in the heel region; and the bit further comprises:

a plurality of scraper elements protruding from the cutter generally at a border between the gage surface and the heel region; and a plurality of hard metal gage inserts inserted within apertures in the gage surface.

7. The earth-boring bit according to claim 1, further comprising a hardfacing composition of carbide particles dispersed in a metallic matrix deposited on at least portions of each of the steel teeth in the heel row.

8. An earth-boring bit comprising:

a bit body;

at least one cantilevered bearing shaft depending inwardly and downwardly from the bit body;

a cutter mounted for rotation on the bearing shaft, the cutter having a gage surface and an adjoining heel region, the cutter including a plurality of cutting elements arranged in circumferential rows on the cutter, the rows including at least one inner row and a heel row, the heel row being located in the heel region;

the cutting elements in the inner row being formed of a hard metal and interference fit into apertures in the cutter; and at least some of the cutting elements in the heel row being steel teeth formed on the cutter, at least portions of each of the steel teeth having a wear-resistant composition formed thereon.

9. The earth-boring bit according to claim 8, further comprising a plurality of scraper elements protruding from the cutter generally at a border between the gage surface and the heel region.

10. The earth-boring bit according to claim 8, further comprising:

a plurality of scraper elements protruding from the cutter generally at a border between the gage surface and the heel region, each of the scraper elements being generally between and outward from two of the steel teeth and formed of a wear-resistant material deposited on the cutter.

11. The earth-boring bit according to claim 8, further comprising:

a plurality of scraper elements protruding from the cutter generally at a border between the gage surface and the heel region; and a plurality of hard metal gage inserts inserted within apertures in the gage surface.

12. The earth-boring bit according to claim 8, further comprising:

a plurality of scraper elements protruding from the cutter generally at a border between the gage surface and the heel region, each of the scraper elements being of hard metal and interference fit into an aperture in the cutter.

13. An earth-boring bit comprising:

a bit body;

at least one cantilevered bearing shaft depending inwardly and downwardly from the bit body;

a cutter mounted for rotation on the bearing shaft, the cutter having a gage surface, the cutter including a plurality of cutting elements arranged in circumferential rows on the cutter, the rows including a plurality of inner rows and a heel row which is adjacent to the gage surface;

the cutting elements in the inner rows being formed of a hard metal and interference fit into apertures in the cutter;

the cutting elements in the heel row being steel teeth formed on the cutter, at least portions of each of the steel teeth having a wear-resistant composition formed thereon;

a plurality of scraper elements protruding from the cutter generally at a border between the gage surface and the heel row; and a plurality of hard metal gage inserts inserted within apertures in the gage surface.

14. The earth-boring bit according to claim 13 wherein the scraper elements are formed of a hardfacing composition of carbide particles dispersed in a metallic matrix deposited on the cutter, each of the scraper elements being located between and outward from two of the steel teeth.

15. The earth-boring bit according to claim 13 wherein the scraper elements are of hard metal and interference fit within apertures.

* * * * *